US006612566B2

(12) United States Patent
Stoll

(10) Patent No.: US 6,612,566 B2
(45) Date of Patent: Sep. 2, 2003

(54) HIGH SPEED PRINTER WITH DUAL ALTERNATE SHEET INVERTERS

(75) Inventor: James S. Stoll, Wolcott, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/340,996

(22) Filed: Jan. 13, 2003

(65) Prior Publication Data

US 2003/0102624 A1 Jun. 5, 2003

Related U.S. Application Data

(62) Division of application No. 09/730,363, filed on Dec. 5, 2000.

(51) Int. Cl.[7] ..... B65H 29/60
(52) U.S. Cl. ..... 271/186; 399/364
(58) Field of Search ..... 271/184, 186; 399/364; 400/582, 599, 599.1, 605, 608, 611, 612

(56) References Cited

U.S. PATENT DOCUMENTS

| | | | | | |
|---|---|---|---|---|---|
| 4,466,733 | A | * | 8/1984 | Pels | 270/58.01 |
| 4,579,446 | A | * | 4/1986 | Fujino et al. | 271/185 |
| 5,287,162 | A | | 2/1994 | de Jong et al. | 355/326 R |
| 5,418,556 | A | | 5/1995 | Andrews | 347/116 |
| 5,510,877 | A | | 4/1996 | de Jong et al. | 355/208 |
| 5,537,190 | A | | 7/1996 | Folkins et al. | 355/214 |
| 5,568,246 | A | | 10/1996 | Keller et al. | 355/309 |
| 5,631,686 | A | | 5/1997 | Castelli et al. | 347/133 |
| 5,669,056 | A | * | 9/1997 | Rubscha | 399/367 |
| 5,720,478 | A | * | 2/1998 | Carter et al. | 271/186 |
| 5,748,221 | A | | 5/1998 | Castelli et al. | 347/232 |
| 5,774,156 | A | | 6/1998 | Guerin | 347/116 |
| 6,014,154 | A | | 1/2000 | Guerin | 347/116 |
| 6,185,406 | B1 | * | 2/2001 | Ueda | 399/364 |
| 6,450,711 | B1 | * | 9/2002 | Conrow | 400/582 |

FOREIGN PATENT DOCUMENTS

| | | | | |
|---|---|---|---|---|
| JP | 59-22847 | * | 2/1984 | 271/186 |

* cited by examiner

*Primary Examiner*—Joseph E. Valenza
*Assistant Examiner*—Mark A. Deuble

(57) ABSTRACT

In high speed reproduction apparatus in which closely spaced printed sheets are sequentially fed downstream in a sheet path at a process velocity, a dual inverter system of two independent but cooperative sheet inverters is sheet control gated to receive alternate sheets from the sheet path for inversion in the alternate independent sheet inverters. These dual alternate sheet inverters may advantageously operate at substantially the same sheet velocity as the connecting sheet path, instead of the much higher speed and acceleration/deceleration typical of conventional single inverter systems. This enables less critical higher speed cut sheet handling and thus more reliable faster printing. Yet collated sequential sheet order is maintained. This dual inverter system may be an integral part of a duplex path to provide inversion of sheets for duplex printing of their other sides.

5 Claims, 9 Drawing Sheets

HIGH SPEED PRINTER WITH DUAL ALTERNATE SHEET INVERTERS

This is a divisional application in response to a restriction requirement for the method claims in Ser. No. 09/730,363 filed Dec. 5, 2000, by the same inventor, and claims priority therefrom. Re-written method claims are provided herein.

Cross-reference is made to a copending and commonly assigned U.S. application Ser. No. 09/730,364,filed on Dec. 5, 2000, now issued as U.S. Pat. No. 6,450,711 on Sep. 17, 2002, by Brian R. Conrow, with the same title. That related application discloses and claims certain below-identified embodiments with a later date of conception by that different inventor. It will be self-evident that certain of those alternative embodiments disclosed herein are encompassed by and generically claimed by various of the claims herein.

Disclosed in the embodiments herein is an improvement in high speed printing utilizing a combination of two cooperative sheet inverters to improve the overall productivity of the printing system. As is well known, sheet inversion properly coordinated and/or collated with the printing sequence is important for duplexing (both sides sheet printing), sheet output collation, finishing, and the like. The system disclosed herein avoids the typical conventional approach of using a much higher paper path (sheet feeding) velocity in a single inverter (which can be as much as twice the normal paper path or process speed of the printer) yet can maintain collation, maintain a proper inter-sheet gap in the sheet path and insure that successively printed sheets do not impact or interfere with one another, even with high speed printing with rapidly successive sheets moving in the paper paths.

With the disclosed embodiments, sequential sheets in the paper path may be alternatingly inverted by the two inverters. Directly sequential sheets need not be inverted in the same inverter. Thus, a much lower speed inverter operation can be employed, providing numerous advantages. For example, with lower speed inverters, less power may be required, acoustic noise may be lower, and system reliability, including reduced sheet jam rates, may be improved. Also, a subsequent sheet need not be delayed for the inversion of a preceding sheet in order to avoid sheet impact or collision, or sheets becoming out of sequential page order in pre-collated printing. Thus, the disclosed dual inverter system embodiments provide opportunities for, improved high speed pre-collated printing productivity without increasing the operating speeds and sheet reversal rates of sheets in the inverter and without requiring an increase in the inter-sheet or inter-pitch gaps between sheets.

By way of background, various types of sheet inverters are known in the art. The following patent disclosures are noted merely by way of a few examples. In particular, there is art on copiers or printers having two sheet inverters in a printer/finisher system where one inverter is in the duplex loop path and the other inverter is in the finisher input or the output path of the copier or printer. Noted, for example, is FIG. 3 of Xerox Corporation U.S. Pat. No. 5,697,040, issued Dec. 9, 1997 to Douglas T. Rabjohns and James S. Stoll. It shows a xerographic printer with both a duplex path sheet inverter and an output path sheet inverter 176. Also, it is known for example from U.S. Pat. No. 5,568,246, issued Oct. 22, 1996 to Paul D. Keller et al, to combine in series two different printing systems into a so-called dual engine printing system. In doing so, the single inverters of each of these print engines provide two inverters, but they are in two separate print engines. Details of other sheet inverters for other reproduction apparatus include, for example, Xerox Corp. U.S. Pat. Nos. 4,986,529 and 5,131,649, and other references cited therein. However, as will be appreciated from the disclosures herein, those systems do not provide the function, result or advantages of the presently disclosed embodiments.

Further by way of technical background, because of the location of the interfaces between the inverter/duplex loop and the rest of the paper path in many printers, the sheet inverter speed, the duplex loop speed, and the exit speed of the printer, often need to be much higher than the process speed. This also imposes difficulties and constraints on the sheet drives, the registration subsystems, etc.

As will be understood by those skilled in the art, the term "process speed" in some contexts can refers to the sheet velocity related to the printing rate of the system. For example, in xerographic systems the process speed may be the velocity at which the image substrate sheet is fed to, and image-transferred at, the transfer station engagement with the photoreceptor belt or drum, which is running at the process speed. In general, it is desirable to be able run most of the rest of the paper paths of the reproduction apparatus at substantially the same process speed. Otherwise, sheet acceleration or deceleration is required at the sheet velocity transition zones of the paper paths, and spacing problems between sequential sheets may arise. Sheet acceleration in particular can cause slippage, or other problems, with the frictional drive wheel or belt systems typically used for sheet feeding in reproduction apparatus (printers or copiers). As is also well known in the art, there is a "handoff" problem in going between a sheet transport or feeder operating at one velocity and the next, or downstream, sheet transport. Other sheet control or registration issues besides slippage can occur, such as rapid nip release of the upstream feed system, or other loss of accurate sheet position control transitioning problems. However, the term "process speed" as used herein, unless specified otherwise, may more broadly encompass the velocity of the sheets moving in the particular paper path to which the dual inverters are operatively connected. Especially since, for example, it is known to run printer output paths and/or duplex paths at a higher sheet transport velocity than the sheet velocity at image transfer.

In many high volume printer architectures being used at the present day, the sheet inversion system requires that all sheets being inverted be rapidly accelerated from the process speed to a much higher inverter speed as they enter the inverter. That is, to be accelerated in a very short distance from a process or other speed to approximately twice the process speed for movement into the inverter. That is typically followed by rapid deceleration of the sheet in the inverter from that higher speed, and then re-acceleration to that higher speed for exiting from the inverter. In addition to the above-described difficulties, this also imposes more critical sheet timing and registration problems. With the disclosed embodiments, the much slower velocity of the sheet in the inverters greatly reduces these problems.

There is an additional potential advantage in providing two inverters capable of alternatively providing the same function in the same basic sheet path location, with each inverter capable of running independently. If one inverter system fails, or becomes temporarily unusable, the overall reproduction system can still operate at a reduced processing speed, without a total shutdown. For example, if there is a paper jam in one inverter, the machine controller can sense this and automatically slow down the printing rate to approximately half speed, and exclusively utilize the other available inverter until the jam is cleared from the jammed inverter.

The disclosed dual alternate inverter embodiments have additional potential advantages. For example, they may utilize, and even duplicate, otherwise conventional or existing inverters or inverter components. That is, this system may use two of any of various well-known or other types of sheet inverters. It may be incorporated into various types of high-speed reproduction apparatus, or finishers therefor, with little modification. For example, an existing high volume Xerox Corporation DocuTech® 5090 or DocuTech® 5390 printer, and their existing high volume finishing systems, such as the Xerox Corporation Model Nos. 4135 or 5090 DocuTech® finishing systems.

The entrance and exit paths and locations of the dual inverters will, of course, vary depending on the desired application of the system and the reproduction apparatus, as will be explained further herein. For example, the location and configuration of the dual inverters and their input and output paths may be different for application in a sheet output or finisher system, as opposed to utilizing the dual inverter system in a duplex loop return path for second side printing. In either case the dual inverters may optionally be in a separate connecting modular unit from the reproduction apparatus.

The functions of both of those two sheet handling and inversion applications are well known per se to those skilled in the art, and need not be discussed in detail herein. The above-cited U.S. Pat. Nos. 5,131,649 and 4,986,529, for example, also shows that a single inverter may be usable for both the functions of duplex path inversion and/or the sheet output inversion. (However, having more than one sheet in an inverter at a time has other issues, and skipping copying pitches to avoid that reduces printing rate productivity.)

As is also well known in the art, sheet inverters may be used even in simplex (only one side printed) printing in some situations. For example, for inverting simplex sheets printed face up in 1 to N (forward serial) order, so that they can be stacked face down as properly collated sets. Or, alternatively, sheets being printed face down (image sides down) in N to 1 (reverse serial) order being inverted for face up stacking. In some systems, having an odd number of natural sheet path inversions, sheet inversion could even required in a sheet path for second color overprinting of the same side of the sheet. That is, the term "inverter" in the art can broadly encompass various systems for avoiding a sheet being turned over, as well as being turned over, and/or reversing the leading edge to trailing edge orientation of the sheet, in the overall sheet path.

A specific feature of the specific embodiments disclosed herein is to provide a high speed reproduction apparatus with a sheet path in which closely sequentially spaced apart printed sheets are fed downstream in said sheet path, said sheet path having an operative connection to a sheet inverter system into which said closely sequentially spaced apart printed sheets in said sheet path are fed to be inverted, the improvement wherein, said sheet inverter system comprises dual inverter system operatively connecting with said sheet path, said dual inverter system comprising two independent but cooperative alternate sheet inverters and a sheet gating control system, said sheet gating control system being programmable and operable to alternately direct alternate said closely sequentially spaced apart printed sheets in said sheet path into said alternate independent sheet inverters.

Further specific features disclosed in the embodiments herein, individually or in combination, include those wherein said closely sequentially spaced apart printed sheets in said sheet path are fed at a process velocity, and wherein both of said two independent but cooperative alternate sheet inverters have internal sheet feeding systems operating at substantially said same process velocity, and/or wherein said two independent but cooperative alternate sheet inverters are connected to operate in parallel with one another relative to said sheet path, and/or wherein said high speed reproduction apparatus has a duplex loop path for returning sheets printed on one side to be printed on their other side, and wherein said two independent but cooperative alternate sheet inverters are alternately connected to form a part of said duplex loop path, and/or wherein said high speed reproduction apparatus has a duplex loop return path for returning sheets printed on one side to be printed on their other side, and wherein said two independent but cooperative alternate sheet inverters have respective sheet entrances connecting with said sheet path via said sheet gating control system at spaced apart positions on said sheet path, and wherein said two independent but cooperative alternate sheet inverters have respective sheet exits connecting to said duplex loop return path in parallel with one another, and/or wherein said high speed reproduction apparatus has a printed sheets output path, and said sheet path is a part of said output path, and/or wherein said sheet path is the output path of said high speed reproduction apparatus, and both of said two independent but cooperative alternate sheet inverters are integral said output path, and/or wherein said two independent but cooperative alternate sheet inverters each have sheet input gates which are spaced apart from one another along said sheet path and which are differently actuated by said sheet gating control system to be alternatingly fed alternate sheets from said sheet path, and/or wherein said two independent but cooperative alternate sheet inverters are respectively located upstream and downstream from one another along said sheet path and on the same side of said sheet path, and/or a method of high speed printing of sheets in a reproduction apparatus so that said sheets are outputted in a pre-collated sequential page order, wherein said printed sheets are being fed through at least one paper path in closely spaced sequential order at a process velocity, and wherein said sheets must be inverted in an inverter system without changing said sequential order of said sheets, the improvement comprising, alternately feeding alternate said sheets being fed through said paper path from said paper path into two alternate sheet inverters comprising said inverter system, sequentially alternately feeding said alternate sheets out of said alternate sheet inverters so as not to change said sequential order of said sheets, and operating both of said alternate sheet inverters at a sheet feeding velocity which is not substantially greater than said process velocity of said paper path, and/or wherein said reproduction apparatus is a duplex printer having a duplex path for feeding said sheets from said paper path for printing their opposite sides, wherein said alternate sheet inverters operatively connect said paper path with said duplex path to provide inversion of said sheets for said printing of their opposite sides, and/or wherein said alternate sheet inverters each have independently operable sheet input gates which are spaced apart from one another along said sheet path and which are differently actuated by a sheet gating control system to be alternatingly fed alternate sheets from said sheet path.

The disclosed system may be operated and controlled by appropriate operation of conventional control systems. It is well-known and preferable to program and execute imaging, printing, paper handling, and other control and logic functions of reproduction apparatus and finishers with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, a disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy". A "print job" is normally a set of related sheets, usually one or more collated copy sets copied from a set of original document sheets or electronic document page images, from a particular user, or otherwise related. A "simplex" document or copy sheet is one having its image and any page number on only one side or face of the sheet, whereas a "duplex" document or copy sheet has "pages", and normally images, on both sides, i.e., each duplex sheet is considered to have two opposing sides or "pages" even though no physical page number may be present.

As to specific components of the subject apparatus or methods, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. Thus, the present invention will be better understood from this description of these specific exemplary embodiments, including the drawing figures (which are approximately to scale) wherein:

Figure 4:
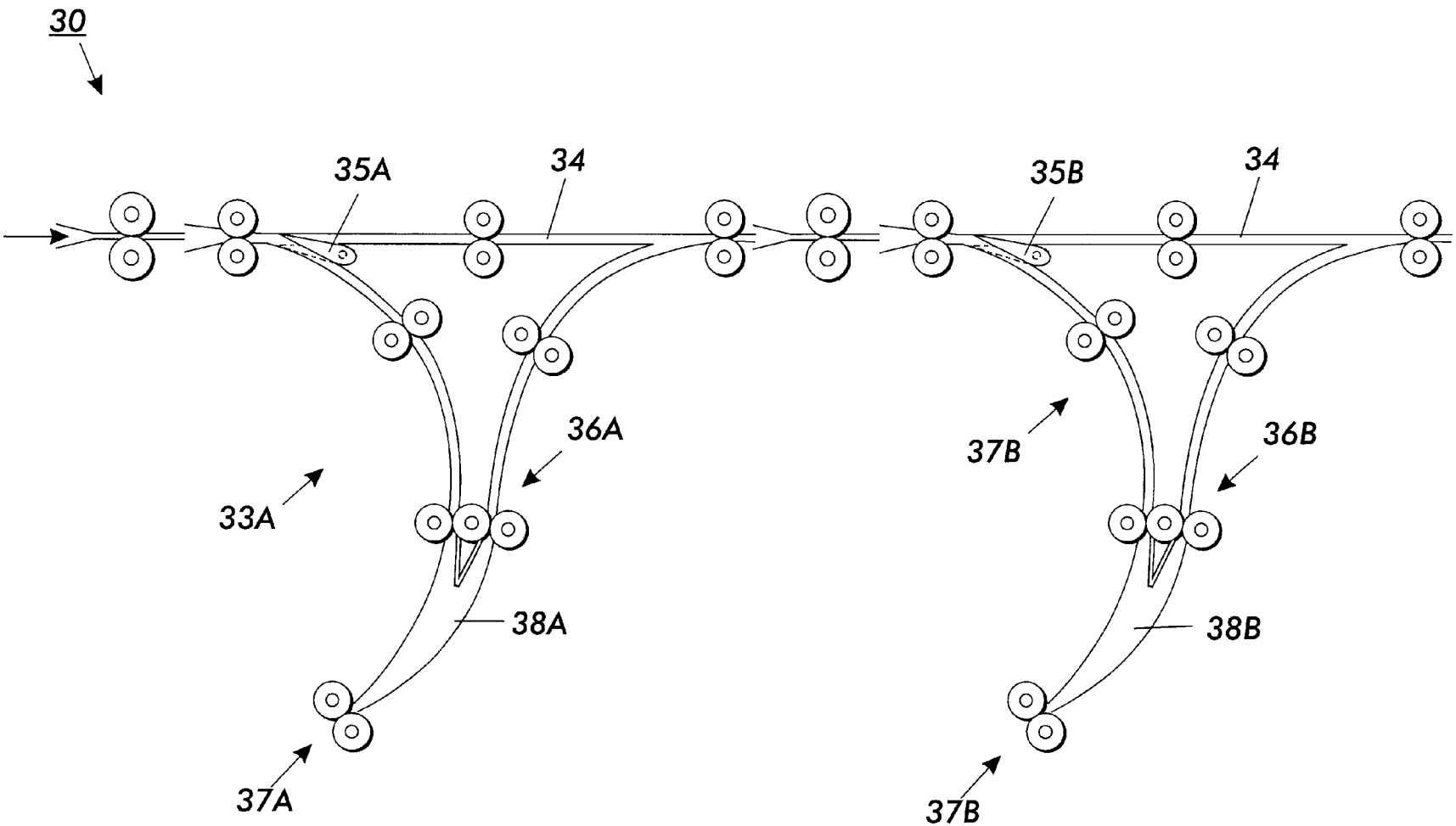
Figure 5:
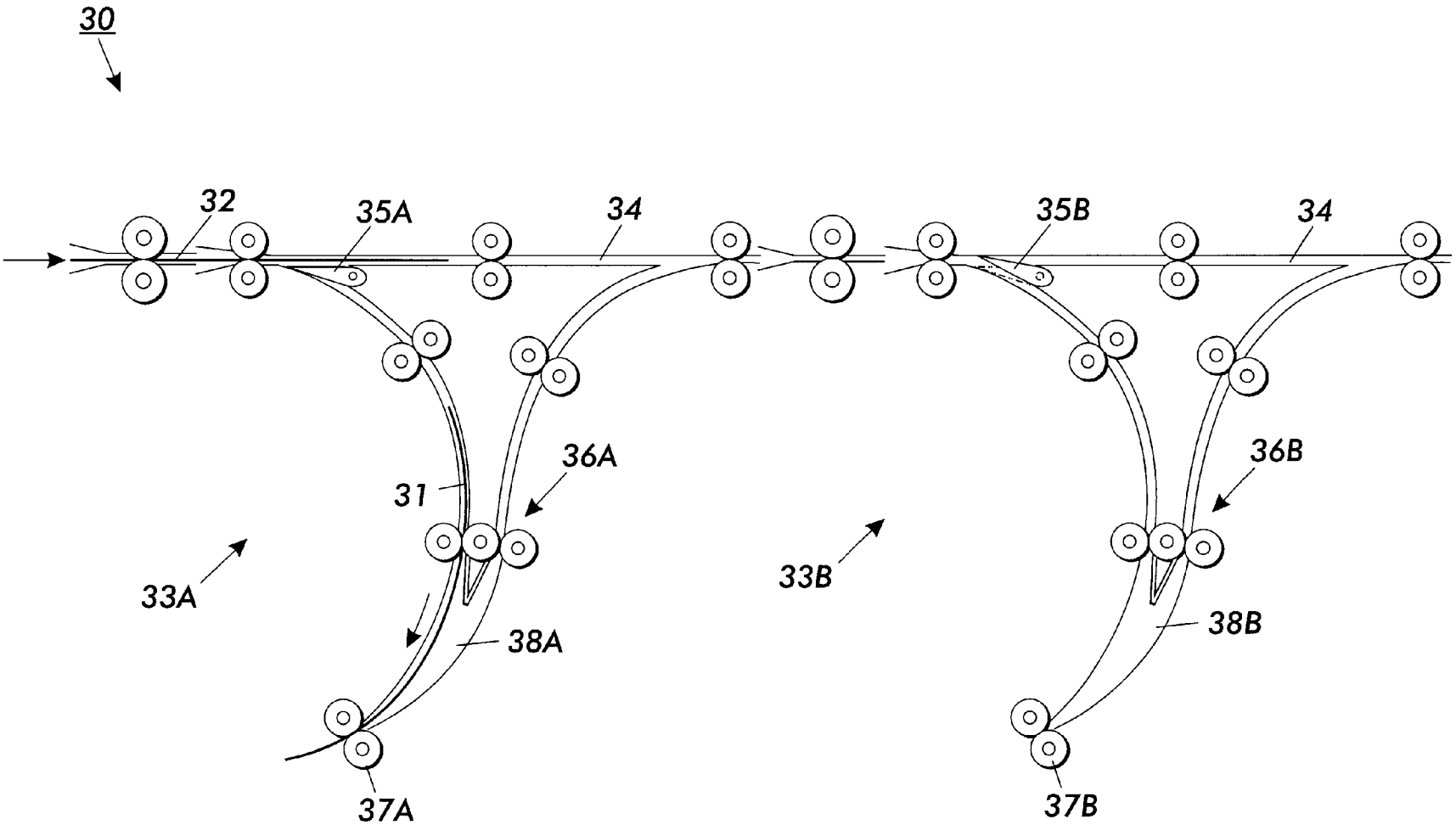
Figure 6:
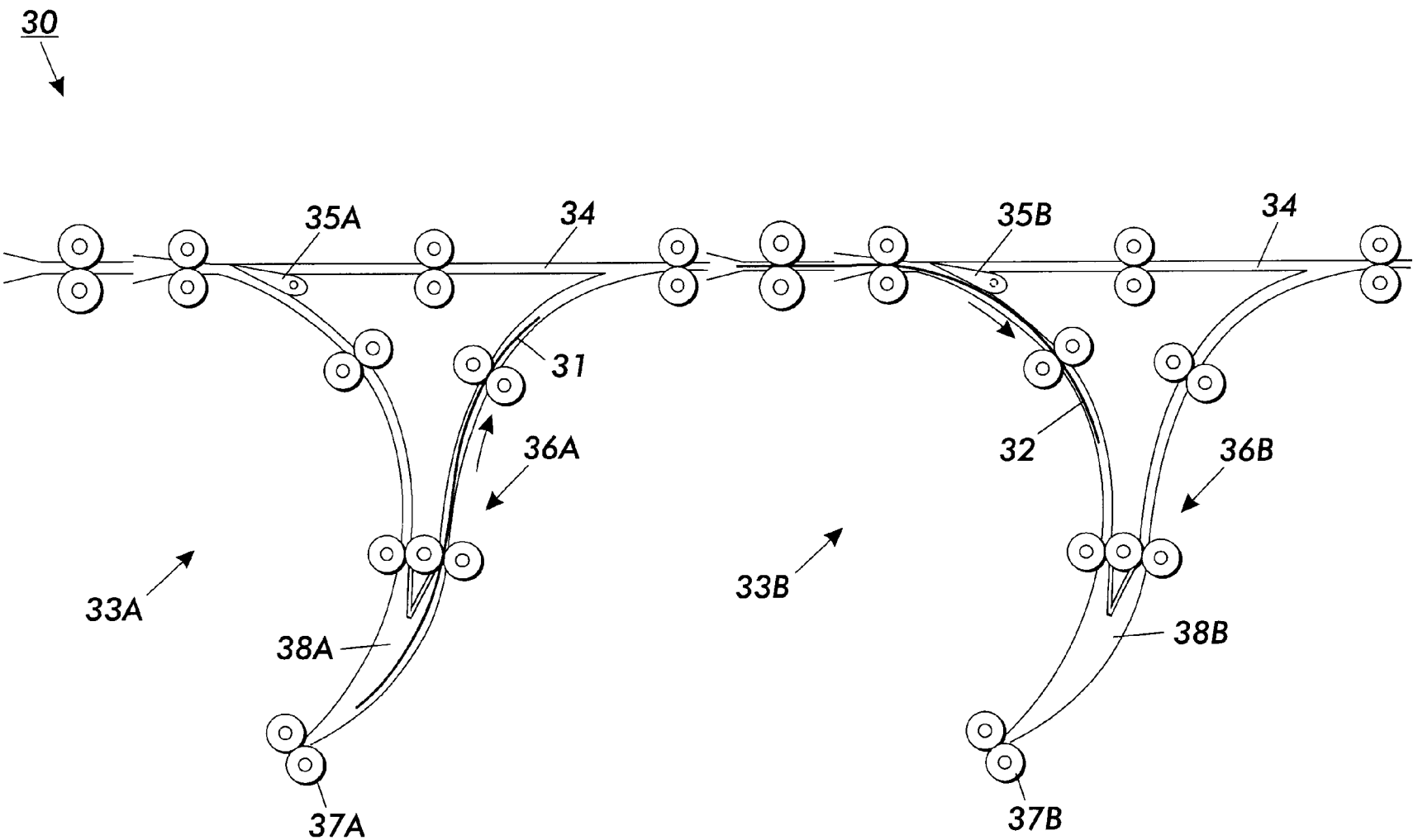
Figure 7:
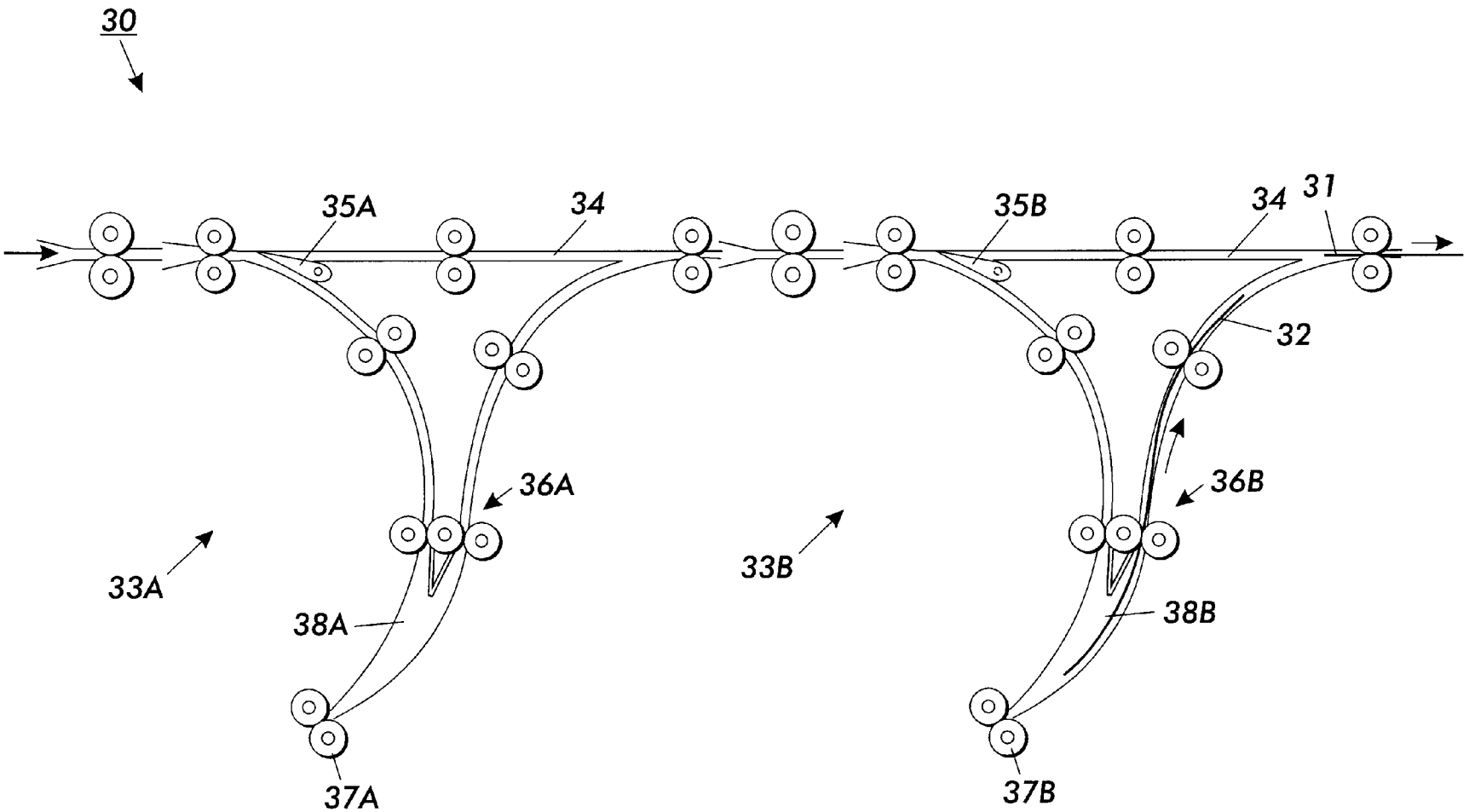
Figure 8:
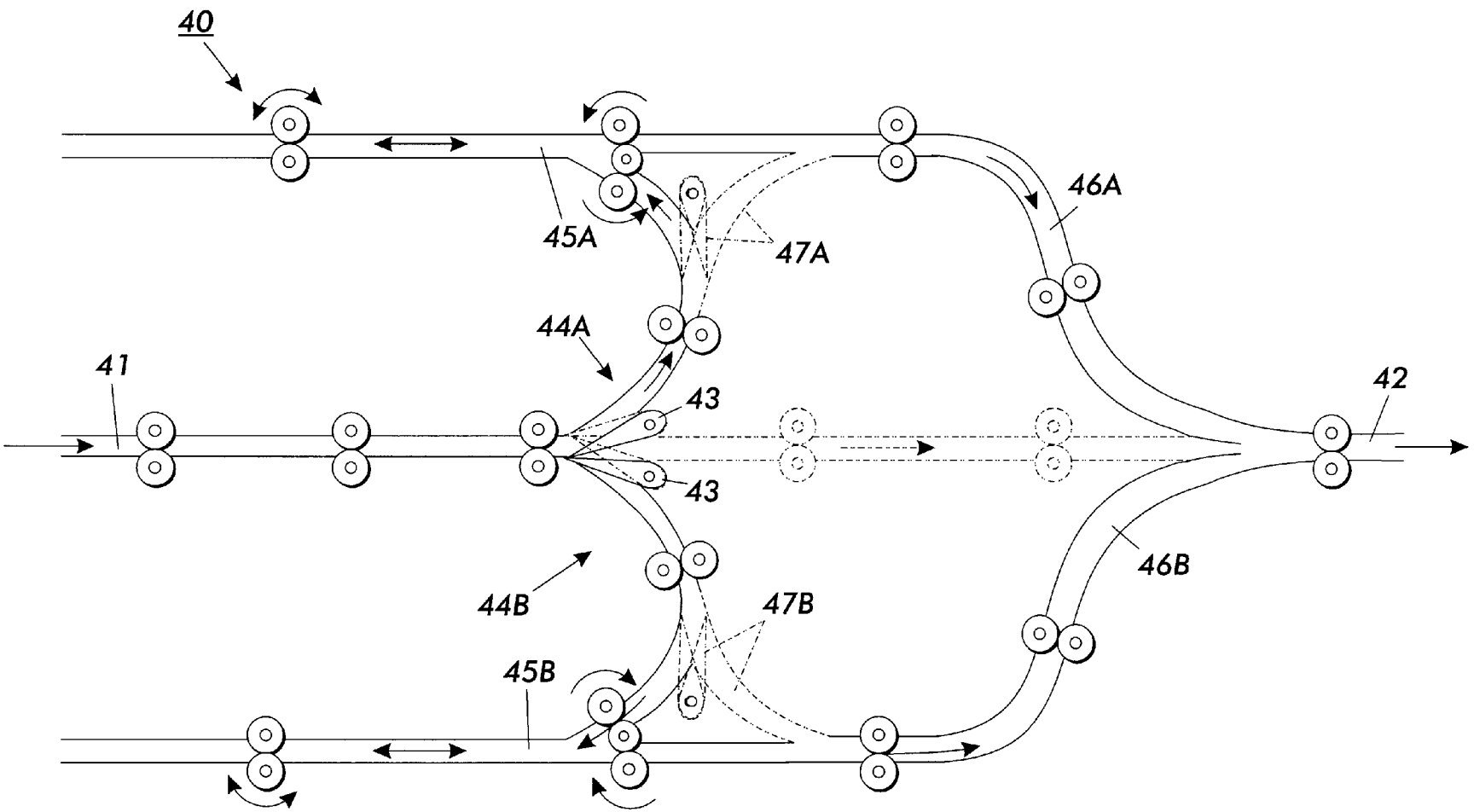
Figure 9:
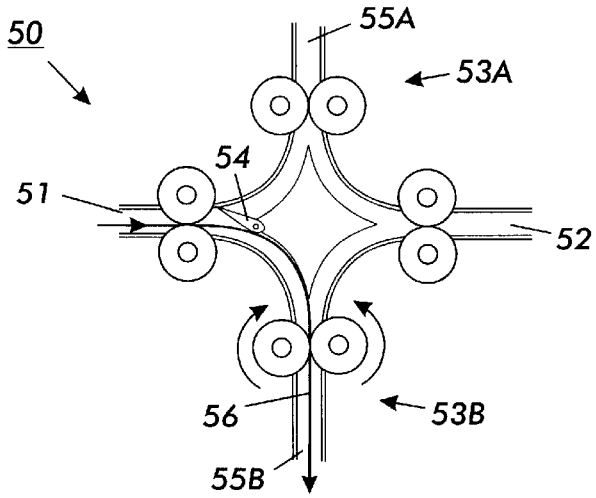
Figure 10:
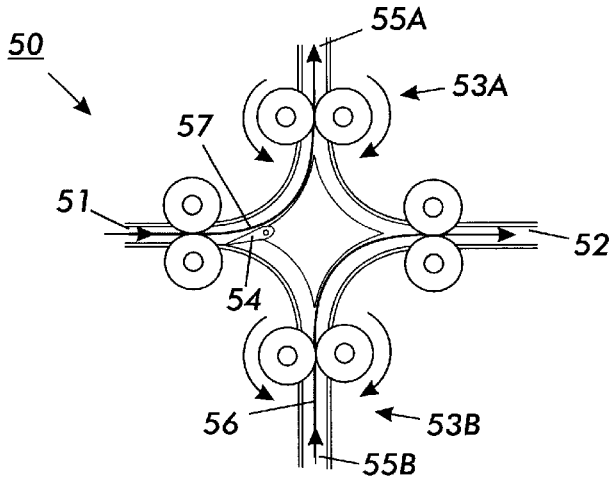
Figure 11:
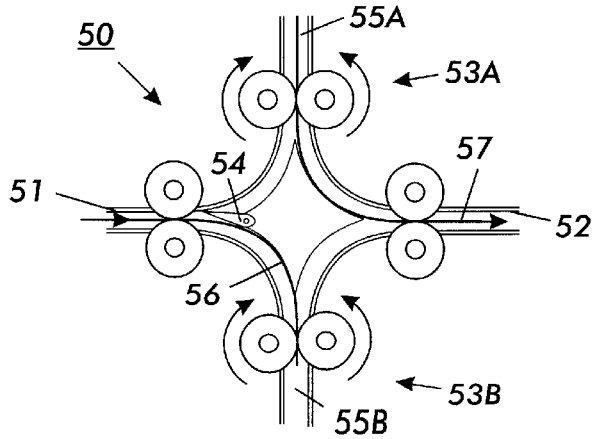

FIG. 4 schematically shows a different embodiment of a dual inverter system, in a cooperative series configuration along a paper path;

FIGS. 5, 6, and 7 show the dual inverter system of FIG. 4 in three sequential operating positions for the inverting of two sequential sheets in the paper path;

FIG. 8 schematically shows another alternative embodiment of a dual inverter system, in a parallel configuration, with inverters on opposite sides of the paperpath; and FIGS. 9–11 schematically show three sequential operation positions for sequential sheets of another embodiment of a dual inverter system, also in a parallel configuration with inverters on opposite sides of the paper path.

Referring to the Figures, it may be seen that although several different alternative embodiments are illustrated, they have in common the basic concept and the advantages described in the above introduction. They all provide dual inverters cooperatively alternatively operating to invert alternate sheets from a sequential stream of sheets being fed in a sheet path. Since various reasons for doing so, and advantages thereof, have been explained in the above introduction they need not be repeated further here.

Figure 1:
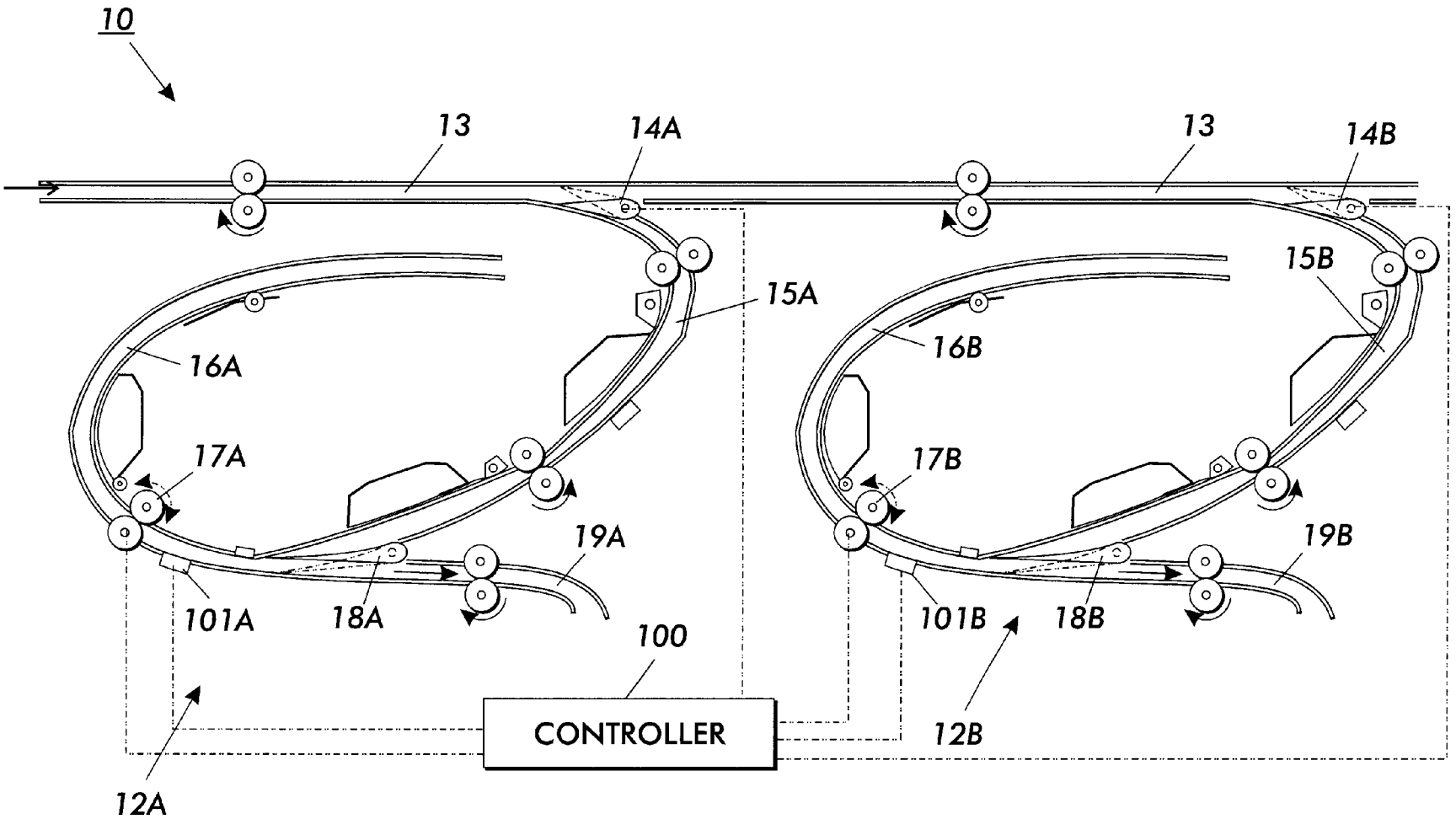
FIG. 1 is a schematic frontal view of one embodiment of a cooperative dual inverter system in accordance with the present invention, in a parallel configuration.
Figure 2:
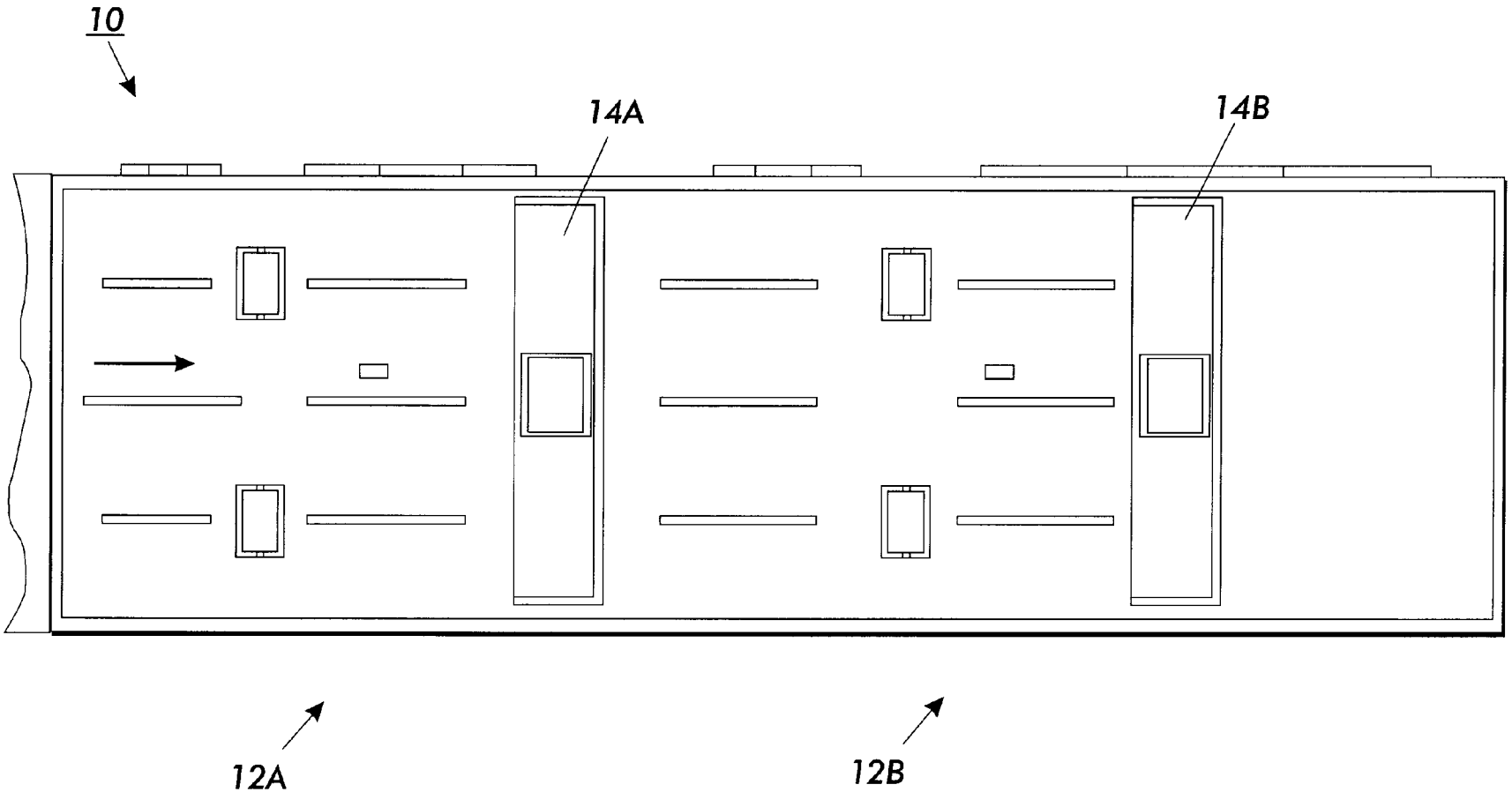
FIG. 2 is a top view of the embodiment of FIG. 1, illustrating the paper path of which it is a part and the inverter decision gates for selecting which sheets will enter which inverter.
Figure 3:
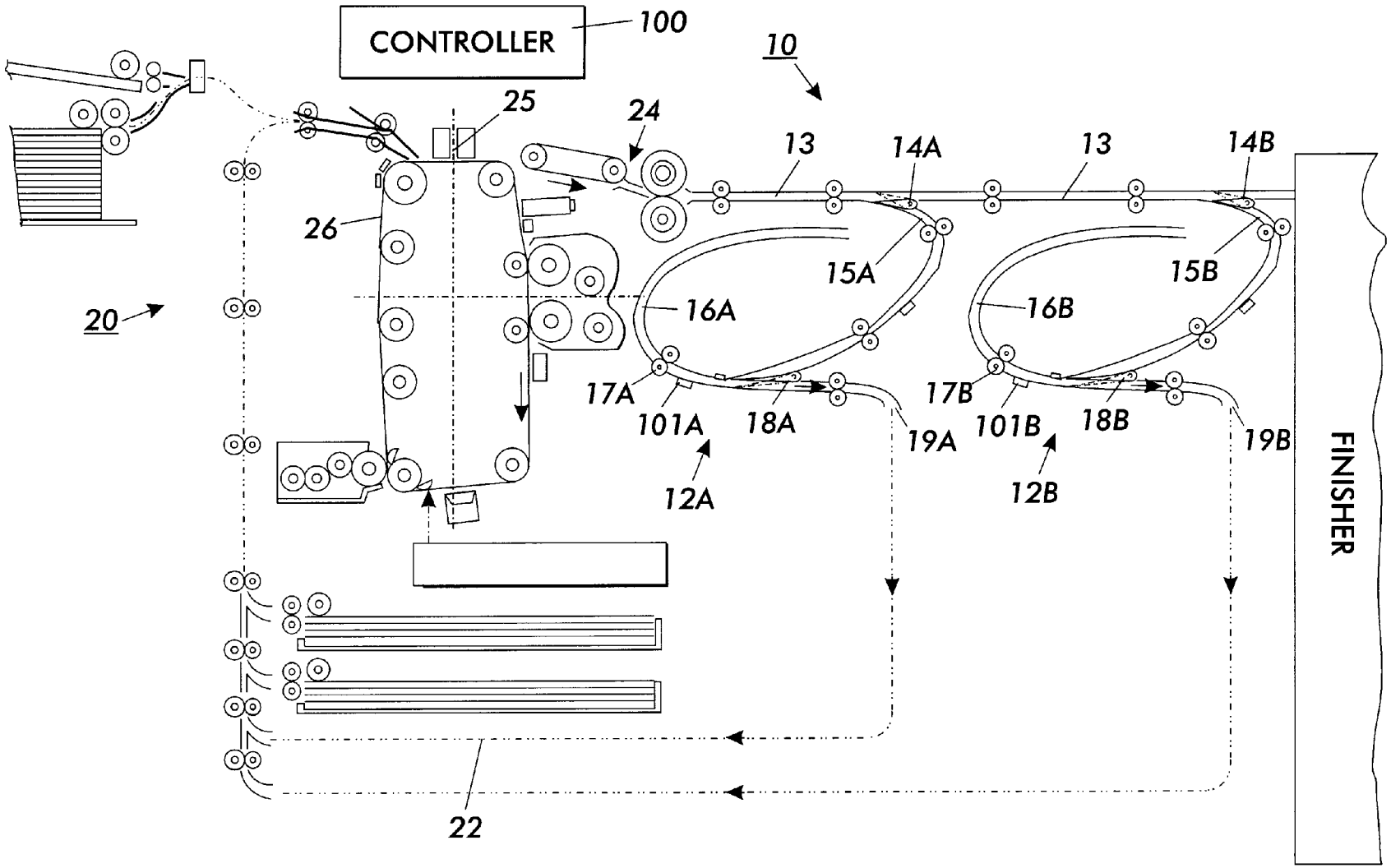
FIG. 3 is a schematic frontal view illustrating the dual inverter system of FIGS. 1 and 2 integrated with one example of a printer, forming the inverter section of a duplex loop path for inverting sheets for their second side printing in that reproduction system.

Referring first to the embodiment of FIGS. 1, 2 and 3, and especially the enlarged view of FIG. 1, there is shown a dual inverter system 10 consisting of two adjacent inverters 12A and 12B in parallel. Both of these inverters 12A and 12B having their sheet inputs connecting to the same paper path 13 at adjacent but spaced apart positions. The connection of the inverters to the paper path 13 in this case (their sheet inputs) is respectively provided by their two respective inverter decision gates 14A and 14B. When activated, these decision gates 14A or 14B extend into the paper path 13 to engage the leading edge of a selected sheet in the paper path 13 and deflect that sheet into the respective inverter entrance path 15A or 15B of the inverter 12A or 12B. This, and other operations, may be under the programmed control of a conventional controller 100 in the associated printer 20 of FIG. 3 or in a separate modular controller of the dual inverter system 10 itself, which may be a modular unit for the printer, and/or part of a finisher module.

When the particular print job calls for, or requires, sheet inversion, the decision gates 14A and 14B may be alternatingly actuated by the controller 100 between each alternating sheet in the sheet path 13, so as to put alternate sequential sheets that are moving in the paper path 13 into alternate inverters 12A or 12B. As noted above, the construction and operation of the two inverters 12A and 12B themselves may be identical, and may be conventional. In this particular embodiment, a sheet is fed through the inverter entrance path 15A or 15B by conventional feed rollers at that point it may pass a paper jam sensor 101A, 101B for jam detection. That sensor 101A, 101B may optionally also be a dual mode sensor sending a control signal to the bi-directional inverter motor for the reversible feed rolls 17A, 17B in the inverter chutes 16A, 16B. After the sheet has continued to be fed fully out of the sheet path 13 it continues to be fed on into the inverter chutes 16A or 16B. In this case, sufficiently far for the trail edge of the sheet (depending on its sheet length) to pass a one-way bypass gate 18A, 18B which is provided in this particular inverter example. Then the reversible rolls 17A, 17B are reversed, that is, reversibly driven, to drive the sheet out through the exit path 19A, 19B.

These one-way bypass gates 18A, 18B may be non-actuated gates such as a conductive light spring steel, or plastic material, that will allow paper to pass through it and they spring back to its normal form, as is well known in other document handlers and other systems in the art. The bi-directional sensor 101A, 101B may be provided in the inverter chute 15A, 15B to provide a two-function paper entrance and exit sensor design. This can provide software algorithm signals to control the drive of the bi-directional inverter motor for the reversible feed rolls 17A, 17B in opposite directions when the respective lead and trail edges of the sheet of paper are detected. These inverters 12A or 12B can automatically accommodate intermixed print jobs, for example, sheets varying from letter size to ledger size. It may be seen that these inverters 12A or 12B of this dual inverter system 10 here also provide large sheet path radii, which reduces potential sheet jam problems.

In some other applications, this exit path 19A, 19B would rejoin the original paper path 13, as shown in other embodiments herein. However, as shown in FIG. 3, in this embodiment, the exit paths 19A, 19B converge into a common output path which is part of an otherwise conventional duplex loop sheet path 22 which returns the sheets inverted back for their second side printing in the printer 20. The exemplary duplex loop sheet path 22 provides conventional second side printing of the sheets being duplexed before they are fed out to the printer 20 output sheet path 24. Of course, sheets being only simplex printed would not need be inverted and fed through this duplex loop path 22. They may go directly to the sheet output path 24, as is well known to those in the art. In this case, desirably passing linearly through the paper path 13 thereto.

For either duplex or simplex printing, the sheets are being conventionally imaged in this particular printer 20 example by passage of the sheets past a transfer station 25 for receiving the images transferred from a photoreceptor 26. Of course, a comparable print station could be provided by inkjet or other printing systems suitable for high speed printing as well. The clean sheets for the initial side printing may be conventionally provided from roll fed or cut sheet (as shown) feed sources, as is well known in the art and need not be described herein. The printer 20 here is merely one example of a high speed xerographic digital laser printer, others of which are cited above, which can rapidly print sheets in proper sequential collated order, that is, pre-collated, thereby allowing direct on-line finishing of print jobs of collated document sets and not requiring an output sorter or collator.

It will be noted that in this particular exemplary embodiment the paper path 13 described above may be considered a continuation of the output sheet path 24 of the printer 20 into a separate module, which may also provide additional sheet feed sources, and/or an interposer module providing for inserting additional preprinted media into the sheet feed stream of the paper path 13. The paper path 13 may typically extend on to one or more various finishing devices, as is also well known in the art. The location(s) of the subject dual inverters may be in various of those units.

It will be appreciated that the signals for actuating the respective inverter entrance or decision gates 14A, 14B may be keyed to the sheet timing and positional signals which are already conventionally available in the printer 20 controller 100 for the sheet lead edge positions. In an efficient printer with variable pitch for variable sheet sizes, the timing and spacing between the lead edges of sequential sheets will, of course, vary depending on the length of the sheet in the process direction within a particular print job, so as to minimize wasted pitch and intra-document space between the various sheets being printed.

As described above, all of the sheet transports within the inverters 12A and 12B may be desirably operated at the same or substantially the same steady state sheet feeding velocity as the sheet transports of the paper path 13 with which it is associated. This process speed may also be, but is not necessarily, the same as the imaging process speed of the printer 20. As described above, this sheet handling provides significant advantages, without risking collision between closely adjacent sheets being printed by the printer 20. In particular, not having to move the sheets much more rapidly through the inverters for the sheet inversion process, and thus also reducing sheet acceleration and deceleration problems. Likewise, no undesirable overlapping of sheets in the inverter system is required and positive sheet feeding control may be obtained at all times. Thus, increased throughput for high speed printing may be provided, yet with increased reliability.

Turning now to the embodiments of the other Figures, as noted above these are additional alternative embodiments with later dates of conception by different inventors covered by various of the claims herein. They all employ the same basic concept of alternately operated dual inverter systems for better high speed printing without the high rate of movement and sheet acceleration/deceleration/acceleration of conventional single inverter systems in high speed printing. FIGS. 4–8 shows two such embodiments by the above cross-referenced applicant. The above descriptions as to gate control functions, sensors, etc., need not repeated for these other embodiments.

Referring to the embodiment of FIGS. 4–7, it may be seen that the same dual inverter structure is shown from the same viewpoint in all four of these Figures. Details of this dual inverter system 30 of FIGS. 4–7 may be otherwise conventional or similar to the dual inverter system 10 of FIGS. 1–3, except that its inverters 33A, 33B are a more conventional type of "three roll inverter" which returns the sheet back to the same paper path 34 after its inversion. Both inverters are positioned on the same side of the paper path 34, as in the embodiment of FIGS. 1–3, which may be desirable for vertical operating space reasons. FIGS. 5, 6 and 7 illustrate an example of the sequential operation of this dual inverter system 30 for two sequential sheets, a first sheet 31 and a second sheet 32. FIG. 5 shows the first sheet 31 having been gated into the first inverter 33A while the second sheet 32 is being fed on past it. In FIG. 6 the second sheet 32 is being gated into the second inverter 33B while the first sheet has been inverted and is about to be fed out of the first inverter 33A. FIG. 7 shows that sheet one (31) has now been fed out into the paper path 34 and fed past the second inverter 33B, and that sheet two (32) is about to be fed out of the second inverter 33B into the paper path 34 right behind sheet one.

The entrance gates 35A, 35B of these inverters 33A and 33B may be operated similarly to the above-described decision gates 14A, 14B of the embodiment of FIGS. 1–3. These inverters 33A, 33B have respective conventional tri-rolls 36A, 36B and inverter chute reversing rolls 37A, 37B in their curved inverting chutes 38A, 38B.

In the above method of operation illustrated in this dual inverter system 30 of FIGS. 5, 6 and 7, the consecutive sheets effectively "leap frog" one another as they travel through the two inverters 33A, 33B. In other words, when a first sheet 31 is being inverted in the first inverter 33A, the next following or second sheet 32 continues along a bypass path between the two inverters (which is provided here by a short connecting portion of the paper path 34), and thereby temporarily moves ahead of the first sheet 31. Then, the second sheet 32 enters the second inverter 33B and while it is being inverted, the first sheet 31 bypasses the second inverter 33B to move ahead of the second sheet 32 so as to thereby move back into the correct collated sheet order. Every two sheet combination can follow this same sequence, and thus the final sheet order and inter-sheet gap may be the same as the initial inter-sheet gap and sheet order in the paper path 34.

It will be appreciated, of course, that if there is an intermix job, with simplex sheets following a duplex sheet, then the operation would be the same as for a conventional single inverter system. That is, it may require a skipped pitch before the simplex sheet, which will be fed directly through the paper path 34 without any inversions.

Turning now to the embodiment of FIG. 8, this is dual inverter system 40 in which the two inverters 44A, 44B are in parallel, and on opposite sides of the paper path. There is a common entrance path 41 and a common exit path 42, in line with one another. In this dual inverter system 40, the sheets all enter on the common entrance path 41 and exit on the common exit path 42. From the common entrance path 41, the sheets may be deflected by an inverter decision gate 43 into either the upper inverter 44A or a lower inverter 44B, respectively having inverter chutes 45A, 45B. Note that these are similar conventional tri-roller type inverters, with reversing rolls in the inverter chutes. However, in this case, each inverter 44A, 44B has a parallel output path 46A, 46B leading from the inverter chute and its tri-roll output to a merger position in the common exit path 42. The single inverter routing gate 43 alternately routes every other sheet to the alternate inverters 44A or 44B to provide alternative sheet inverting passage between the entrance path 41 and the exit path 42. For simplex (non-inversion) additional decision gates and a bypass may be provided as shown in phantom at 47A, 47B. Alternatively, the inverter routing gate 43 may be, as shown, a three-way gate, and have a central position allowing the feeding of simplex sheets through that gate 43 straight through from the common entrance path 41 to the common exit path 42, thereby eliminating any need for bypass gates and paths 47A, 47B. This alternative simplex path is shown in FIG. 8 by the phantom lines paper path directly connecting the common entrance path 41 to the common exit path 42 through gate 43, all in a common plane.

Referring now to the embodiment of FIGS. 9–11, it may be seen that this is another parallel type of dual inverter system 50. From an input paper path 51 alternate sheets are alternately gated into an upper inverter 53A or a lower inverter 53B by a selectable decision gate 54, and returned from the inverters to an output paper path 52. The two inverters 53A and 53B are on directly opposite sides of the paper path defined by this input path 51 and output path 52, which may be in a common plane. (In this system 50, there is a not a continuous paper path, and no simplex or non-inverting path.) The sequence of operations for two successive (first and second) sheets 56 and 57 is successively shown in these three FIGS. 9–11.

The respective inverter chutes 55A, 55B in this system 50 are shown extending linearly perpendicularly away from one another. However, it will be appreciated that this can be a more vertical space consuming configuration than the folded over or arcuate inverter chutes of the other embodiments, such as the inverter chutes 45A, 45B of FIG. 8.

It will be appreciated that various presently unanticipated alternatives, modifications, variations or improvements in these or other embodiments may be made in the future, which are also intended to be encompassed by the following claims.

What is claimed is:

1. A method of high speed sheet printing with a single high speed print engine having a sheet output path in which closely spaced apart printed sheets printed by said single high speed print engine are sequentially fed downstream at an established high velocity in said sheet output path in a desired sheet sequence from said single high speed print engine, in which a cooperative dual inverter system comprising at least two cooperatively operated but independent sheet inverters mounted in sheet receiving communication with said same sheet output path, both of which sheet inverters have sheet input and sheet output connections with said sheet output path, selectably directing selected ones of said closely sequentially spaced apart printed sheets from said sheet output path into and out of said two independent sheet inverters via said respective sheet input and sheet output connections with said same sheet output path at spaced apart positions along said sheet path, to invert alternate said sheets in both of said two independent sheet inverters in time-overlapping operations of said two independent sheet inverters and to return said sheets to said sheet path from both of said two independent sheet inverters inverted and in the same said closely spaced apart desired sheet sequence in said same sheet output path.

2. The method of high speed sheet printing with a single high speed print engine of claim 1, wherein said high speed print engine has an optional duplex loop return path returning sheets printed on one side to be printed on their other side, and wherein said two cooperatively operated but independent sheet inverters each have additional optional sheet exit paths optionally connecting to feed sheets into said optional duplex loop return path.

3. The method of high speed sheet printing with a single high speed print engine of claim 1, wherein said sheets are printed in sequential page order and all of said sheets are returned to said same sheet output path from both of said two independent sheet inverters in the same said sequential page order by sequentially alternately feeding said alternate sheets out of said two independent sheet inverters so as not to change said sequential order of said sheets.

4. The method of high speed sheet printing with a single high speed print engine of claim 1, wherein both of said independent sheet inverters feed said sheets internally thereof at a sheet feeding velocity which is not substantially greater than said established high velocity in said sheet output path.

5. The method of high speed sheet printing with a single high speed print engine of claim 1, wherein said at least two independent but cooperatively operated sheet inverters are respectively located upstream and downstream from one another along said sheet output path and on the same side of said output sheet path.

* * * * *